US011221186B2

(12) United States Patent
Retersdorf et al.

(10) Patent No.: US 11,221,186 B2
(45) Date of Patent: Jan. 11, 2022

(54) HEAT EXCHANGER CLOSURE BAR WITH SHIELD

(71) Applicant: Hamilton Sundstrand Corporation, Charlotte, NC (US)

(72) Inventors: Alan Retersdorf, Avon, CT (US); Donald E. Army, Enfield, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 26 days.

(21) Appl. No.: 16/515,830

(22) Filed: Jul. 18, 2019

(65) Prior Publication Data

US 2021/0018280 A1 Jan. 21, 2021

(51) Int. Cl.
*F28F 13/00* (2006.01)
*F28F 7/00* (2006.01)

(52) U.S. Cl.
CPC ..... *F28F 13/00* (2013.01); *F28F 7/00* (2013.01)

(58) Field of Classification Search
CPC ..... F28F 13/00; F28F 13/02; F28F 7/00
USPC ..... 165/135
See application file for complete search history.

(56) References Cited

U.S. PATENT DOCUMENTS 3,247,899 A * 4/1966 Branch ..... F28D 9/0062 165/166
3,262,496 A * 7/1966 Bawabe ..... F28D 9/0068 165/166
3,265,129 A * 8/1966 Bawabe ..... F28D 9/0062 165/166
3,517,731 A * 6/1970 Rothman ..... F28D 9/0062 165/70
3,542,124 A * 11/1970 Bridgnell ..... F28F 3/027 165/166
3,601,185 A * 8/1971 Rothman ..... F28F 3/025 165/166
4,301,863 A * 11/1981 Bizzarro ..... F28D 9/0062 165/166
4,352,273 A * 10/1982 Kinsell ..... B64D 13/06 62/87
4,804,041 A * 2/1989 Hasegawa ..... F28D 1/0366 165/166
4,934,455 A * 6/1990 Hasegawa ..... F28D 1/0366 165/166
6,520,252 B1 * 2/2003 Bizzarro ..... F28D 9/0062 165/166

(Continued)

FOREIGN PATENT DOCUMENTS

DE 102012208100 A1 11/2013
EP 1788337 A1 5/2007

(Continued)

OTHER PUBLICATIONS

Extended European Search Report for EP Application No. 19216231.1, dated May 19, 2020, 7 pages.

*Primary Examiner* — Claire E Rojohn, III
(74) *Attorney, Agent, or Firm* — Kinney & Lange, P.A.

(57) ABSTRACT

A heat exchanger for managing thermal energy between a flow of a first fluid and a flow of a second fluid includes first and second parting sheets and a closure bar extending between the first and second parting sheets. The closure bar includes an elongate body, a shield positioned upstream from the body relative to a direction of the flow of the first fluid, and a support connecting the shield to the closure bar.

18 Claims, 3 Drawing Sheets

(56) References Cited

U.S. PATENT DOCUMENTS

| | | | | |
|---|---|---|---|---|
| 8,689,858 | B2 * | 4/2014 | Rothenhofer | F28D 1/0366 165/166 |
| 8,869,877 | B2 * | 10/2014 | Zaffetti | F28F 3/12 165/80.4 |
| 9,279,626 | B2 * | 3/2016 | Berukhim | F28F 9/028 |
| 10,782,074 | B2 * | 9/2020 | Miller | F28D 9/0056 |
| 2012/0073793 | A1 * | 3/2012 | Kuehne | F28D 9/0062 165/170 |
| 2013/0140010 | A1 * | 6/2013 | Parfenov | F28F 3/027 165/165 |
| 2014/0290920 | A1 * | 10/2014 | Ouradnik | F28F 3/025 165/140 |
| 2017/0146300 | A1 * | 5/2017 | Lester | F28D 15/0283 |
| 2020/0340403 | A1 * | 10/2020 | Bartosz | B64D 41/00 |
| 2020/0340751 | A1 * | 10/2020 | Retersdorf | F28D 9/0068 |
| 2020/0340761 | A1 * | 10/2020 | Retersdorf | F28F 3/04 |
| 2020/0400377 | A1 * | 12/2020 | Retersdorf | F28D 9/0062 |

FOREIGN PATENT DOCUMENTS

| | | | |
|---|---|---|---|
| EP | 2485005 | A2 | 8/2012 |
| FR | 6520252 | A1 | 4/2018 |

* cited by examiner

HEAT EXCHANGER CLOSURE BAR WITH SHIELD

STATEMENT OF GOVERNMENT INTEREST

This invention was made with government support under Contract #FA8626-16-C-2139 awarded by the Air Force. The government has certain rights in the invention.

BACKGROUND

The present disclosure relates generally to heat exchangers and more particularly to closure bars incorporated into a heat exchanger.

Many heat exchangers include layered structures containing flow channeled or restricted via closure bars. For heat exchangers exposed to large temperature differentials, closure bars at the heat exchanger inlet are subjected to higher temperatures than at other locations. Thermal growth of the closure bar(s) can result in significant stress and potential damage to other heat exchanger parts.

SUMMARY

A heat exchanger for managing thermal energy between a flow of a first fluid and a flow of a second fluid includes a first parting sheet, a second parting sheet, and a closure bar. The closure bar extends between the first and second parting sheets and includes an elongate body, a shield, and a support. The shield is positioned upstream from the body relative to the hot flow direction. The support connects the shield to the closure bar.

A method of managing thermal energy in a heat exchanger includes impinging a flow of a first fluid onto a closure bar of the heat exchanger. The closure bar includes a body and a shield. The body includes a first surface that faces towards the flow of the first fluid and a second surface on an opposite side of the body from the first surface. The shield is positioned upstream from the body relative to a direction of the flow of the first fluid and is spaced from the body by a gap. Thermal energy is absorbed from the flow of the first fluid by the shield. The flow of the first fluid to the body of the closure bar is impeded with the shield. A portion of the flow of the first fluid is diverted away from the first surface of the closure bar by the shield.

A closure bar of a heat exchanger includes a body, a shield, and a support. The body includes a first surface that faces towards a flow of a first fluid and a second surface on an opposite side of the body from the first surface. The shield is positioned upstream from the body relative to a direction of the flow of the first fluid and is spaced from the body by a gap. The support connects the shield to the closure bar. A first portion of the support is connected to and extends from the first surface of the closure bar. A second potion of the support is connected to and extends from the shield.

The present summary is provided only by way of example, and not limitation. Other aspects of the present disclosure will be appreciated in view of the entirety of the present disclosure, including the entire text, claims, and accompanying figures.

Figure 1:
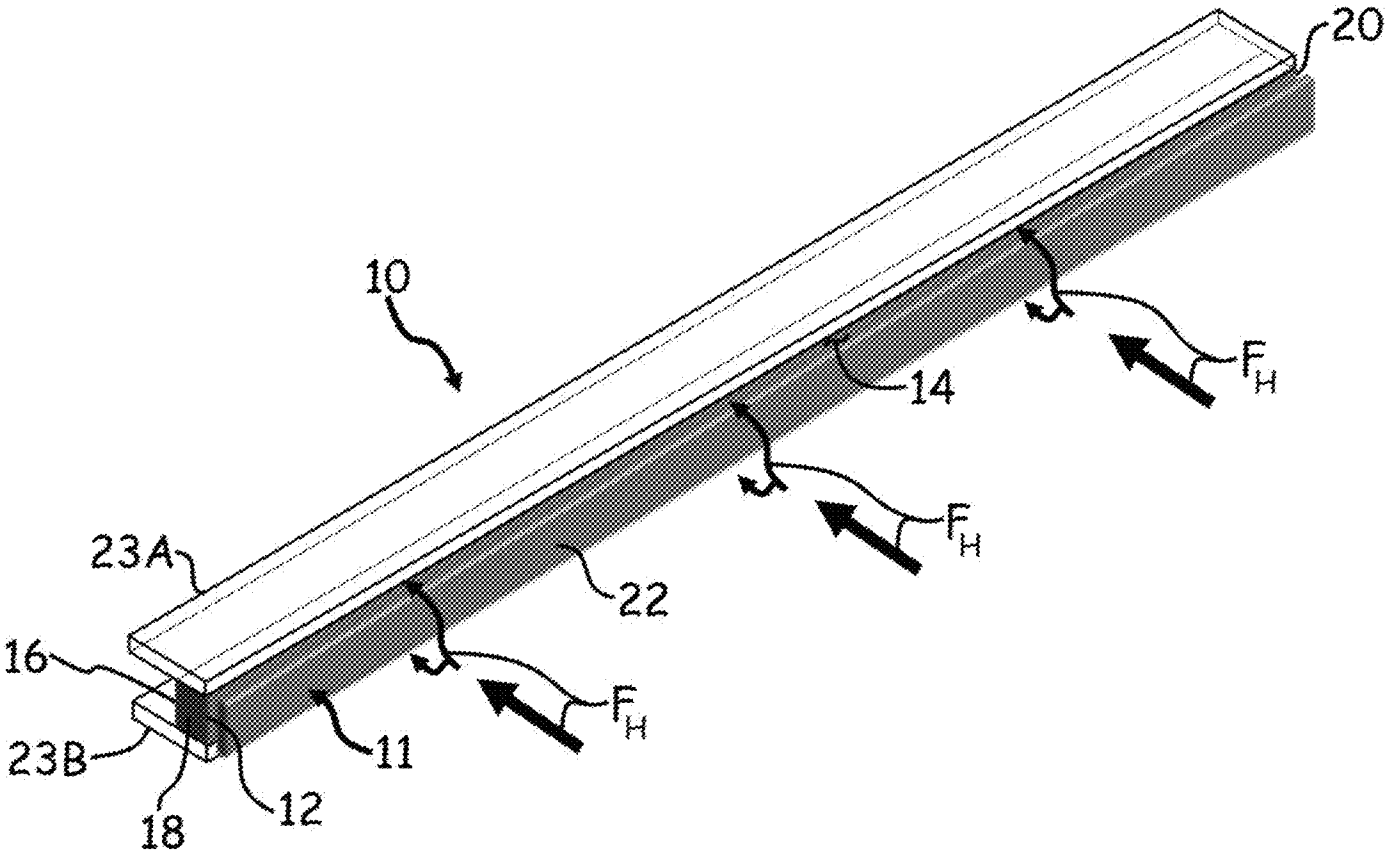
FIG. 1 is a perspective view of a heat exchanger closure bar with a heat shield.

While the above-identified figures set forth one or more embodiments of the present disclosure, other embodiments are also contemplated, as noted in the discussion. In all cases, this disclosure presents embodiments by way of representation and not limitation. It should be understood that numerous other modifications and embodiments can be devised by those skilled in the art, which fall within the scope and spirit of the principles of the disclosure. The figures may not be drawn to scale, and applications and embodiments of the present disclosure may include features and components not specifically shown in the drawings.

DETAILED DESCRIPTION

The present disclosure presents a heat exchanger closure bar incorporating an integrated heat shield that sits just upstream from the closure bar. Impinging hot air flow hits the heat shield to slow down transient responses of the closure bar and alleviate thermal growth differentials with nearby components.

FIG. 1 is a perspective view of a portion of heat exchanger 10 and shows a closure bar 11, a body 12, with a first surface 14, a second surface 16, a first end 18, a second end 20, a shield 22, a first parting sheet 23A, a second parting sheet 23B, and a hot flow $F_H$ of a first fluid.

Closure bar 11 is a piece of material. In this example, a material of closure bar 11 includes a metal. In one non-limiting embodiment, closure bar 11 is a part of a heat exchanger in an environmental control system of an aircraft. Body 12 is a bulk of solid material of closure bar 11. First surface 14 and second surface 16 are exterior faces or sidewalls of body 12. First end 18 and second end 20 are opposite ends of body 12. Shield 22 is a thin, elongated piece of solid material that is a part of closure bar 11. In this non-limiting embodiment, the first fluid of hot flow $F_H$ is a hot air. First parting sheet 23A and second parting sheet 23B are flat pieces of solid material.

Closure bar 11 is positioned between parting sheets (not shown) as part of a heat exchanger. First surface 14 of body 12 faces towards hot flow $F_H$ of the first fluid. Second surface 16 is located on an opposite side of body 12 as from first surface 14. First end 18 is positioned on an opposite end of body 12 from second end 20. Shield 22 is positioned upstream from body 12 relative to a direction of hot flow $F_H$ of the first fluid and is spaced from body 12 by a gap. As will be discussed with respect to FIGS. 2 and 3A, shield 22 is attached to body 12 via physical supports. First parting sheet 23A and second parting sheet 23B are positioned on opposite sides of and in contact with body 12.

During operation of the heat exchanger, closure bar 11 functions as a barrier to prevent mixing of various air flows between different zones of a heat exchanger, such as hot flow $F_H$ of the first fluid with a cold flow of air. Shield 22 is positioned in front (e.g., upstream from) of closure bar 11 such that the impinging hot flow $F_H$ hits shield 22 and not closure bar 11. Shield 22 protects closure bar 11 from direct exposure to hot flow $F_H$ of the first fluid impinging on first surface 14 of body 12. This added thermal resistance provided by shield 22 will slow down transient responses of closure bar 11 and alleviate thermal growth differentials and thermal stresses with nearby components.

Figure 2:
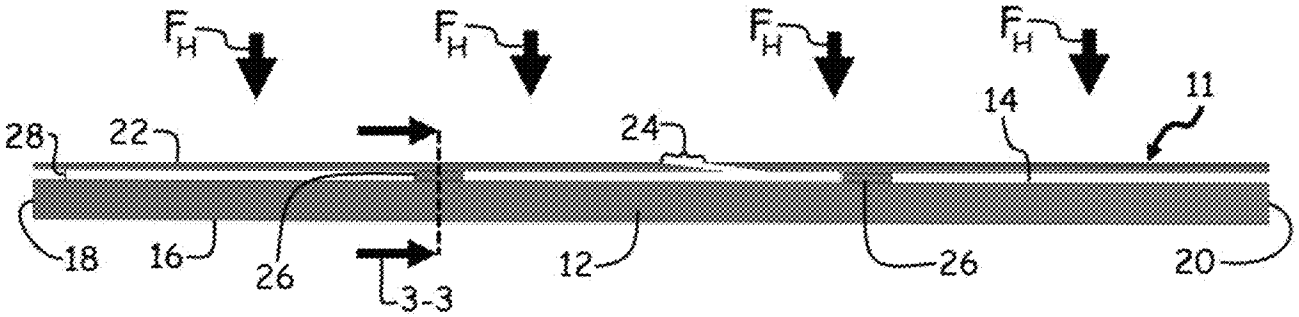
FIG. 2 is a top view of the closure bar with the heat shield.

FIG. 2 is a top view of closure bar 11 of heat exchanger 10 and shows body 12, first surface 14, second surface 16, first end 18, second end 20, shield 22, first parting sheet 23A, second parting sheet 23B, hot flow $F_H$ of the first fluid, opening 24, supports 26, and gap 28.

Opening 24 is a cut-out or space in shield 22. In this example, one opening 24 is shown. In other examples, more than one opening can be in shield 22. Supports 26 are columns or blocks of solid material. In this example, two supports 26 are shown. In other examples, more or less than two supports 26 can be included. In some non-limiting embodiments, a shape of supports 26 can include a cylinder, polyhedron (e.g., cuboid), sphere, or other geometrical shapes. In this example, supports 26 include a cross-sectional area that is smaller than (or reduced from) a height of shield 22. Gap 28 is an opening or space. As can be seen both with respect to FIG. 2 and with respect to FIGS. 3A-3B (described in greater detail below), supports 26 can be slender and infrequent connecting structures, relative to both shield 22 and body 12.

In this example, shield 22 includes a plurality of shield portions. Shield 22 is spaced from body 12 by gap 28. Opening 24 is shown as cut diagonally into shield 22, diagonally relative to a major axis of body 12 of closure bar 11. In this example, each shield portion of shield 22 is separated from an adjacent shield portion by opening 24. Supports 26 connect shield 22 to body 12 of closure bar 11 while conducting heat from shield 22 to body 12 only slowly, relative to direct attachment. A first portion of each of supports 26 is connected to and extends from first surface 14 of closure bar 11 and a second potion of each of supports 26 is connected to and extends from a portion of shield 22. Gap 28 is positioned and extends between first surface 14 of body 12 and shield 22.

In one non-limiting embodiment, a portion of hot flow $F_H$ of the first fluid is impinged onto shield 22 of closure bar 11. Thermal energy from hot flow $F_H$ of the first fluid is absorbed by shield 22. Shield 22 impedes hot flow $F_H$ of the first fluid to body 12 of closure bar 12. In other words, shield 22 protects or shields body 12 of closure bar 12 from being directly impacted by hot flow $F_H$ of the first fluid. In another non-limiting embodiment, shield 22 can be hollow to provide additional thermal resistance between the impinging hot flow $F_H$ and closure bar 11.

Opening 24 provides clearance between adjacent portion of shield 22 to allow for the portions of shield 22 to thermally expand as shield 22 absorbs thermal energy from hot flow $F_H$ of the first fluid. The diagonal orientation of opening 24 relative to the major axis of body 12 slows down hot flow $F_H$ of the first fluid by not providing a straight-through direct flow path for hot flow $F_H$ of the first fluid to directly flow to body 12 of closure bar 11. Gap 28 acts to cut-off a direct thermal energy conductive flowpath from shield 22 to body 12. For example, gap 28 acts as a quiescent zone behind shield 22 to minimize how much thermal energy is being transferred by using gap 28 as an insulator. Additionally, the spaces between supports 26 also act to minimize the direct thermal contact between shield 22 and body 12.

With shield 22 blocking hot flow $F_H$ of the first fluid from being directly received by body 12 of closure bar 11, the transfer of thermal energy between hot flow $F_H$ of the first fluid and body 12 is slowed down significantly thereby reducing thermal differentials and subsequent thermal stresses between closure bar 11 and surrounding heat exchanger components such as parting sheets. Opening 24 helps to prevent stresses between shield 22 and supports 26 as body 12, shield 22, and supports 26 grown and/or contract due to thermal expansion and contraction.

Figure 3A:
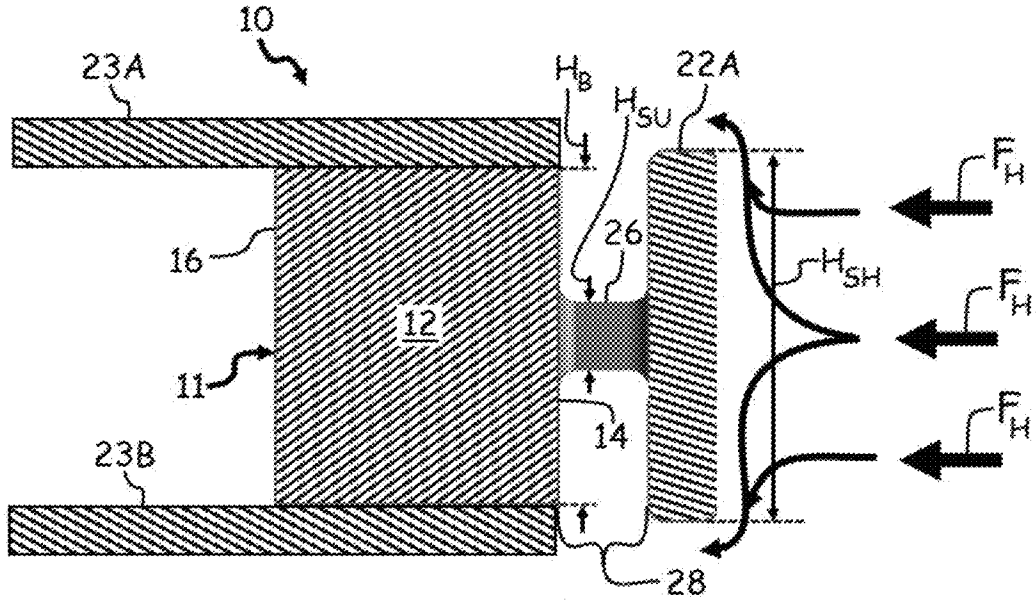
FIG. 3A is a side cross-section view taken along 3-3 in FIG. 2 of the closure bar with the heat shield.

FIG. 3A is a side cross-section view taken along 3-3 in FIG. 2 of closure bar 11 and shows shield 22A as including a rectangular cross-section shape with rounded corners. Height $H_B$ of closure body 12 height $H_{SH}$ of shield 22A, and height $H_{SU}$ of support 26 are also shown in FIG. 3A.

Height $H_B$ is a height of closure body 12 shown as extending from a bottom edge to a top edge of body 12 as oriented in FIG. 3A. Height $H_{SH}$ is a height of shield 22A shown as extending from a bottom edge to a top edge of shield 22A in FIG. 3A. Height $H_{SU}$ is a height of support 26 as extending from a bottom edge to a top edge of support 26 in FIG. 3A. In this example, height $H_{SH}$ of shield 22A is greater than height $H_B$ of body 12. With height $H_{SH}$ of shield 22A being greater than height $H_B$ of body 12, shield 22A completely blocks or impedes hot flow $F_H$ of the first fluid from directly coming into contact with first surface 14 of body 12. In other non-limiting embodiments, however, height $H_{SH}$ of shield 22A can be less than or equal to height $H_B$ of body 12. Also in this example, height $H_{SU}$ of support is shown as less than height $H_{SH}$ of shield 22A and less than height $H_B$ of body. In one non-limiting embodiment, height $H_{SU}$ support 26 can be 75% less than a height of shield 22. Likewise, a width of support 26 (e.g., with the width of support 26 extending into and out of the page in FIG. 3A) can be 75% less than a height of shield 22.

In this example of a rectangular shaped shield 22A, a flat sidewall of shield 22A faces into hot flow $F_H$ of the first fluid which redirects hot flow $F_H$ of the first fluid around shield 22A along a direction (up and/or down as shown in FIG. 3A) that is perpendicular to the downstream direction of hot flow F of the first fluid (shown as right to left in FIG. 3A).

Figure 3B:
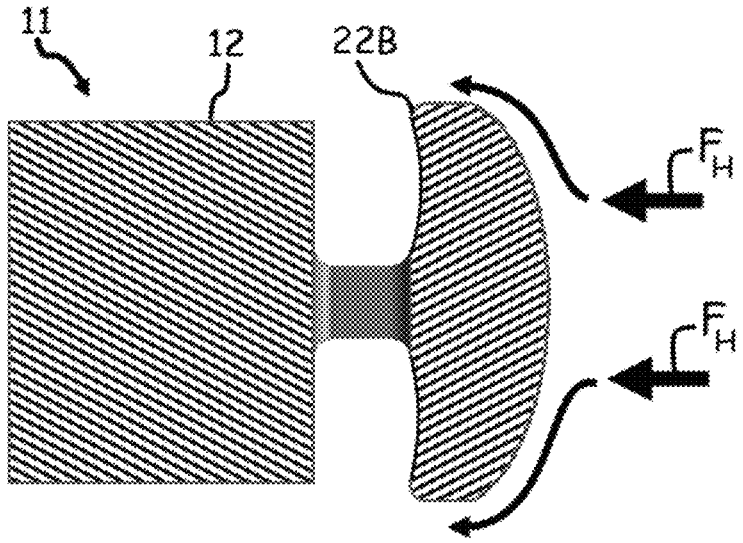
FIG. 3B is a side cross-section view of the closure bar with a bull-nose shaped heat shield.

FIG. 3B is a side cross-section view of closure bar 11 with shield 22B including a bullnose cross-sectional shape. The cross-sectional bullnose shape of shield 22B provides less direct resistance than the rectangular shape of shield 22A, yet still blocks body 12 of closure bar 11 from hot flow $F_H$ of the first fluid. Shield 22B with the bullnose cross-sectional shape could be used in configurations where a small pressure drop is needed across shield 22B. In another embodiment, the bullnose shape of shield 22B can conform to the shape of a leading edge of an airfoil.

Discussion of Possible Embodiments

A heat exchanger for managing thermal energy between a flow of a first fluid and a flow of a second fluid includes a first parting sheet, a second parting sheet, and a closure bar. The closure bar extends between the first and second parting sheets and includes an elongate body, a shield, and a support. The shield is positioned upstream from the body relative to the hot flow direction. The support connects the shield to the closure bar.

The heat exchanger of the preceding paragraph can optionally include, additionally and/or alternatively, any one or more of the following features, configurations and/or additional components.

The elongate body can comprise a first surface that faces towards the flow of the first fluid and/or a second surface on an opposite side of the body from the first surface.

A first portion of the support can be connected to and/or extend from the first surface of the closure bar, wherein a second potion of the support can be connected to and/or extend from the shield.

The shield can be spaced from the body by a gap.

The shield can comprise a plurality of shield portions.

Each shield portion of the plurality of portions can be separated from an adjacent shield portion by an opening in the shield.

An opening in the shield can be angled relative to the hot flow direction.

The support can comprise a cylindrical, cuboid, or spherical shape, and wherein the support can comprises a height that is less than a height of the shield and/or less than a height of the body.

A cross-sectional shape of the shield can comprise a rectangle with rounded corners.

A cross-sectional shape of the shield can comprise a bullnose.

A cross-sectional shape of the shield can comprise an airfoil.

A method of managing thermal energy in a heat exchanger includes impinging a flow of a first fluid onto a closure bar of the heat exchanger. The closure bar includes a body and a shield. The body includes a first surface that faces towards the flow of the first fluid and a second surface on an opposite side of the body from the first surface. The shield is positioned upstream from the body relative to a direction of the flow of the first fluid and is spaced from the body by a gap. Thermal energy is absorbed from the flow of the first fluid by the shield. The flow of the first fluid to the body of the closure bar is impeded with the shield. A portion of the flow of the first fluid is diverted away from the first surface of the closure bar by the shield.

A closure bar of a heat exchanger includes a body, a shield, and a support. The body includes a first surface that faces towards a flow of a first fluid and a second surface on an opposite side of the body from the first surface. The shield is positioned upstream from the body relative to a direction of the flow of the first fluid and is spaced from the body by a gap. The support connects the shield to the closure bar. A first portion of the support is connected to and extends from the first surface of the closure bar. A second potion of the support is connected to and extends from the shield.

The closure bar of the preceding paragraph can optionally include, additionally and/or alternatively, any one or more of the following features, configurations and/or additional components.

The shield can comprise a plurality of shield portions.

Each shield portion of the plurality of portions can be separated from an adjacent shield portion by an opening in the shield.

A cross-sectional shape of the shield can comprise a rectangle with rounded corners.

A cross-sectional shape of the shield can comprise a bullnose.

A cross-sectional shape of the shield can comprise an airfoil.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger for managing thermal energy between a flow of a first fluid and a flow of a second fluid comprising:

a first parting sheet;

a second parting sheet; and a closure bar extending between the first and second parting sheets, wherein the closure bar comprises:

a body having a body height extending between the first and second parting sheets, and an elongate length transverse to the height;

a shield positioned upstream from the body relative to a hot flow direction of the first fluid, the shield having a shield height greater than the body height; and a support connecting the shield to the closure bar.

2. The heat exchanger of claim 1, wherein the body comprises:

a first surface that faces into the hot flow direction of the first fluid; and a second surface on an opposite side of the body from the first surface.

3. The heat exchanger of claim 2, wherein a first portion of the support is connected to and extends from the first surface of the closure bar, wherein a second potion of the support is connected to and extends from the shield.

4. The heat exchanger of claim 1, wherein the shield is spaced from the body by a gap.

5. The heat exchanger of claim 1, wherein the shield comprises a plurality of shield portions.

6. The heat exchanger of claim 5, wherein each shield portion of the plurality of portions is separated from an adjacent shield portion by an opening in the shield.

7. The heat exchanger of claim 6, wherein the opening in the shield is angled relative to the hot flow direction.

8. The heat exchanger of claim 1, wherein the support comprises a cylindrical, cuboid, or spherical shape, and wherein the support has a height that is less than the shield height and less than the body height.

9. The heat exchanger of claim 1, wherein a cross-sectional shape of the shield comprises a rectangle with rounded corners.

10. The heat exchanger of claim 1, wherein a cross-sectional shape of the shield comprises a bullnose.

11. The heat exchanger of claim 1, wherein a cross-sectional shape of the shield comprises an airfoil.

12. A method of managing thermal energy in a heat exchanger, the method comprising:

impinging a flow of a first fluid onto a closure bar of the heat exchanger, wherein the closure bar comprises:

a body comprising:

a first surface that faces towards the flow of the first fluid, the first surface extending primarily along an elongate length, the first surface having a body height transverse to the elongate length; and a second surface on an opposite side of the body from the first surface; and a shield positioned upstream from the body relative to a direction of the flow of the first fluid, wherein the shield is spaced from the body by a gap and has a shield height greater than the body height;

absorbing thermal energy, with the shield, from the flow of the first fluid;

impeding, with the shield, the flow of the first fluid to the body of the closure bar; and diverting, with the shield, a portion of the flow of the first fluid away from the first surface of the closure bar.

13. A closure bar of a heat exchanger, the closure bar comprising:

a body comprising:

a first surface that faces towards a flow of a first fluid, the first surface extending primarily along an elongate length, the first surface having a body height transverse to the elongate length; and a second surface on an opposite side of the body from the first surface;

a shield positioned upstream from the body relative to a direction of the flow of the first fluid, wherein the shield is spaced from the body by a gap and has a shield height greater than the body height; and a support connecting the shield to the closure bar, a first portion of the support is connected to and extends from the first surface of the closure bar, wherein a second potion of the support is connected to and extends from the shield.

14. The closure bar of claim 13, wherein the shield comprises a plurality of shield portions.

15. The closure bar of claim 13, wherein each shield portion of the plurality of portions is separated from an adjacent shield portion by an opening in the shield.

16. The closure bar of claim 13, wherein a cross-sectional shape of the shield comprises a rectangle with rounded corners.

17. The closure bar of claim 13, wherein a cross-sectional shape of the shield comprises a bullnose.

18. The closure bar of claim 13, wherein a cross-sectional shape of the shield comprises an airfoil.

* * * * *